US010928120B2

(12) United States Patent
Chen et al.

(10) Patent No.: US 10,928,120 B2
(45) Date of Patent: Feb. 23, 2021

(54) COOLING APPLIANCE

(71) Applicant: BSH HAUSGERAETE GMBH, Munich (DE)

(72) Inventors: Jinghui Chen, Nanjing (CN); Michael Krapp, Nattheim (DE); Wuba Lei, Chuzhou (CN); Hao Zhang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 199 days.

(21) Appl. No.: 16/190,223

(22) Filed: Nov. 14, 2018

(65) Prior Publication Data

US 2019/0162464 A1 May 30, 2019

(30) Foreign Application Priority Data

Nov. 27, 2017 (CN) ..... 201721604470.4

(51) Int. Cl.
*F25D 23/06* (2006.01)
*B65D 81/38* (2006.01)

(52) U.S. Cl.
CPC ..... *F25D 23/064* (2013.01); *B65D 81/3823* (2013.01); *F25D 23/066* (2013.01); *F25D 2600/04* (2013.01)

(58) Field of Classification Search
CPC ..... F25D 23/064; F25D 23/06; F25D 23/062; F25D 23/063; F25D 23/065;
(Continued)

(56) References Cited

U.S. PATENT DOCUMENTS 3,132,382 A * 5/1964 Magester ..... F25D 23/064 312/406
3,137,744 A * 6/1964 Burrus ..... F25D 23/064 264/46.5

(Continued)

FOREIGN PATENT DOCUMENTS

DE 7826431 U1 * 12/1978 ..... F25D 23/064
DE 102011087100 A1 * 5/2013 ..... F25D 23/064

(Continued)

OTHER PUBLICATIONS

WO 9964800 translation (Year: 2020).*

*Primary Examiner* — Daniel J Rohrhoff
(74) *Attorney, Agent, or Firm* — Laurence A. Greenberg; Werner H. Stemer; Ralph E. Locher

(57) ABSTRACT

A cooling appliance has a heat insulation shell. The shell includes an outer wall and an inner wall that are spaced apart from each other, and a heat insulation material located between the outer wall and the inner wall. The heat insulation material is formed by foaming a foaming material injected between the outer wall and the inner wall. The shell has a filling hole formed in the outer wall, and a baffle plate located between the outer wall and the inner wall and used for closing the filling hole. The baffle plate is connected to the outer wall. The filling hole includes a near end close to the connecting end and a far end away from the connecting end. The outer wall inclines towards the inner wall in a direction from the near end to the far end on an area on which the filling hole is disposed.

9 Claims, 8 Drawing Sheets

(58) Field of Classification Search
CPC . F25D 23/066; B65D 81/3823; B65D 43/164; B65D 43/16; B29C 44/12; B29C 44/1228
USPC ..... 220/828, 827, 810; 264/46.5
See application file for complete search history.

(56) References Cited

U.S. PATENT DOCUMENTS 3,364,941 A * 1/1968 Harder ..... F16K 15/144 137/849
3,478,922 A * 11/1969 Mole ..... B60K 15/04 220/86.2
3,739,936 A * 6/1973 Jones, Jr. ..... F25D 23/065 220/86.1
4,118,451 A * 10/1978 Schaus ..... B29C 44/351 264/46.5
4,129,935 A * 12/1978 Daley ..... B29C 44/581 206/320
5,512,345 A * 4/1996 Tsutsumi ..... F25D 23/063 220/592.27
5,560,695 A * 10/1996 Pufpaff ..... B29C 65/565 312/406
8,178,992 B1 * 5/2012 Meller ..... F03D 9/25 290/55
9,132,592 B2 * 9/2015 Tobbe ..... B29C 70/68
2012/0266962 A1 * 10/2012 Wilson ..... F25D 23/064 137/1
2013/0257257 A1 * 10/2013 Cur ..... B29C 65/002 312/406.1
2019/0145697 A1 * 5/2019 Naik ..... F25D 23/062 312/400
2019/0285336 A1 * 9/2019 Naik ..... F25D 23/062

FOREIGN PATENT DOCUMENTS

WO WO-9964800 A1 * 12/1999 ..... B29C 44/581
WO WO-2016029963 A1 * 3/2016 ..... B29C 44/581

* cited by examiner

COOLING APPLIANCE

CROSS-REFERENCE TO RELATED APPLICATION

This application claims the priority, under 35 U.S.C. § 119, of Chinese application CN 201721604470.4, filed Nov. 27, 2017; the prior application is herewith incorporated by reference in its entirety.

BACKGROUND OF THE INVENTION

Field of the Invention

The present utility model relates to the field of electrical appliance technologies, and in particular, to a cooling appliance.

A cooling appliance includes a shell, and the shell has an outer wall and an inner wall that are spaced apart from each other, and the inner wall encircles a chamber used for refrigeration or freezing. To provide the shell with a good heat preservation effect, a heat insulation material is usually filled between the outer wall and the inner wall, and the heat insulation material is usually formed by foaming and curing a polyurethane foaming material.

In the prior art, to enable the polyurethane foaming material to be filled between the inner wall and the outer wall of the shell, a filling hole and a baffle plate are usually disposed on the outer wall. The baffle plate can be opened in a filling process, and closed after the filling is completed, to prevent an uncured polyurethane foaming material from leaking to the outside.

However, the existing outer wall is usually horizontally or vertically disposed, and regardless of whether the filling hole is disposed on a top surface, a back surface, or a side surface of the outer wall, in a process of filling the foaming material, a wall surface on which the filling hole is located is usually vertically disposed. The existing baffle plate is hinged on the outer wall, and is closed by using gravity to block the filling hole. However, the baffle plate under the effect of gravity cannot be completely adhered to the wall surface on which the filling hole is located, and cannot completely block the filling hole, causing leakage of the foaming material.

SUMMARY OF THE INVENTION

An objective of embodiments of the present utility model is to provide a cooling appliance, which can help improve the foaming quality.

To resolve the foregoing problem, the present utility model provides a cooling appliance, including: a heat insulation shell. The shell includes an outer wall and an inner wall that are spaced apart from each other, and a heat insulation material is located between the outer wall and the inner wall. The heat insulation material is formed by foaming a foaming material injected between the outer wall and the inner wall in a foaming process of the shell. The shell has a filling hole disposed on the outer wall, and a baffle plate located between the outer wall and the inner wall and used for closing the filling hole. The baffle plate is connected to the outer wall, and the filling hole includes a near end close to a connecting end and a far end away from the connecting end. The outer wall inclines to the inner wall in a direction from the near end to the far end on an area on which the filling hole is disposed.

Compared with the prior art, in this technical solution, an area that is on the outer wall and on which the filling hole is disposed inclines to the inner wall in a direction from the near end to the far end. Therefore, in a foaming process, an inner surface of the area on which the filling hole is disposed can incline upward. After filling of the foaming material is completed, when a filling tube is pulled out of the filling hole, the baffle plate can fall down under the effect of gravity, and the area that inclines upward can prevent the baffle plate from falling down, so that the baffle plate can be better adhered to the inner surface of the area, and the filling hole can be completely blocked, to prevent the foaming material between the outer wall and the inner wall from leaking to the outside.

Optionally, an angle by which the area on which the filling hole is disposed inclines to the inner wall is controlled to be less than 30°.

If the inclined angle is excessively large, it may be difficult to dispose the bottom plate, making the assembly technique complex, and increasing the manufacturing difficulty; and also making it difficult to insert the filling tube of the foaming material into the filling hole, and increasing the foaming difficulty.

Optionally, the baffle plate is hinged on the outer wall.

Optionally, one side of the baffle plate away from the connecting end is provided with a clump weight.

The clump weight can make the baffle plate quickly rotate to fall down, and provide the fallen baffle plate with a large adhesive force with the bottom plate, to better block the filling hole.

Optionally, a wall surface of the outer wall on which the filling hole is disposed inclines to the inner wall.

Optionally, the outer wall includes a bottom plate disposed at the bottom of the cooling appliance, and the filling hole is disposed on the bottom plate.

In the foaming process, the back plate of the cooling appliance is horizontally placed, and the filling hole is disposed on the bottom plate, so that the filling tube of the foaming material can be inserted into the filling hole conveniently. Because the baffle plate is disposed on the bottom plate, the baffle plate can fall down under the effect of gravity, to be adhered to the bottom plate, to block the filling hole, and simplify the design of the baffle plate.

When the cooling appliance is used, the bottom plate is faced to the ground, so that even if the bottom plate is provided with the filling hole, it is difficult to be noticed by consumers, so that the cooling appliance has a better appearance.

Optionally, the outer wall is provided with multiple filling holes, and the multiple filling holes are located on a same plane.

In this case, in the foaming process, the foaming material may be filled by using multiple filling holes simultaneously, to increase the filling efficiency of the foaming material, and prevent the foaming material from curing in advance due to slow filling.

Optionally, the outer wall includes: multiple plates, where the multiple plates are joined together to form the outer wall; and at least one beam, where the beam is disposed between two neighboring plates of the multiple plates, to fixedly connect the two neighboring plates; and the filling hole is disposed on the beam.

The beam is relatively thick, and relatively strong, and disposing the filling hole and the baffle plate on the beam basically does not deform the beam, thereby simplifying the technique of disposing the filling hole and the baffle plate on the outer wall, reducing the production processes, and reducing the production costs.

Optionally, the baffle plate is hinged to the beam.

Optionally, the baffle plate has a hinge shaft suitable for hinge connection, and the hinge shaft extends along a length direction of the beam.

Optionally, the multiple plates include a back plate and a bottom plate, the beam includes a first wall and a second wall that are fixedly disposed, the first wall is fixedly connected to the back plate, and the second wall is fixedly connected to the bottom plate.

Optionally, the filling hole is disposed on the second wall.

Both the filling hole and the baffle plate are disposed on the second wall, and the baffle plate can fall down under the effect of gravity, to be adhered to the second wall, to block the filling hole, and simplify the design of the baffle plate. In addition, when the cooling appliance is used, the second wall is faced to the ground, so that even if the second wall is provided with the filling hole, it is difficult to be noticed by consumers, so that the cooling appliance has a better appearance.

Optionally, an included angle $\alpha$ between the first wall and the second wall satisfies: $90° < \alpha \leq 120°$.

Other features which are considered as characteristic for the invention are set forth in the appended claims.

Although the invention is illustrated and described herein as embodied in a cooling appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

To make the foregoing objectives, features, and advantages of the present utility model more obvious and comprehensible, the following describes specific embodiments of the present utility model in detail with reference to the accompanying drawings.

First Embodiment

Figure 1:
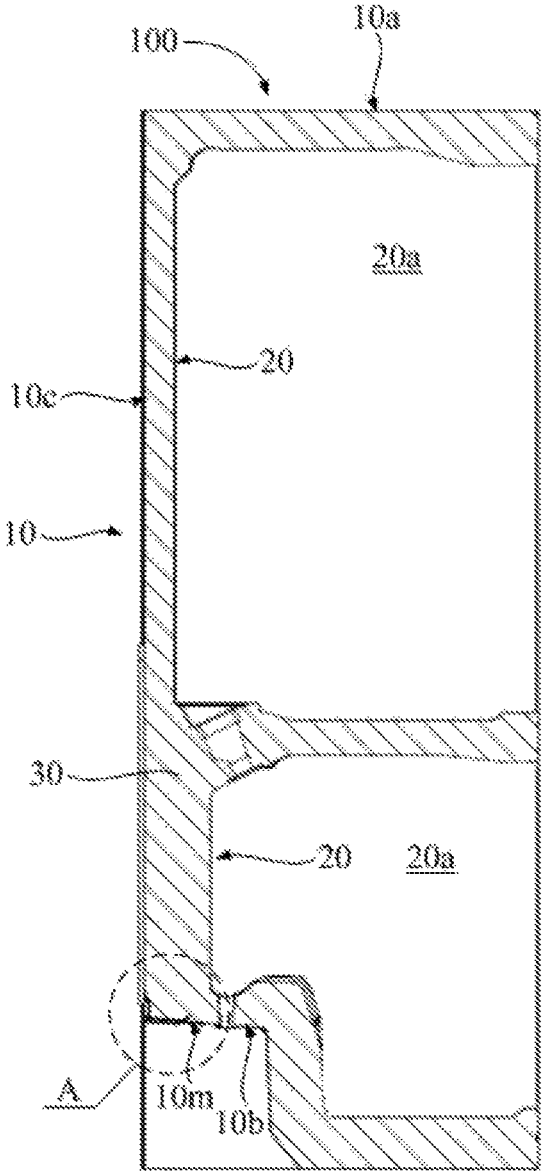
FIG. 1 is a diagrammatic, sectional view obtained after a heat insulation material is filled in a shell of a cooling appliance according to a first embodiment of the invention, to display a filling hole and a baffle plate.
Figure 2:
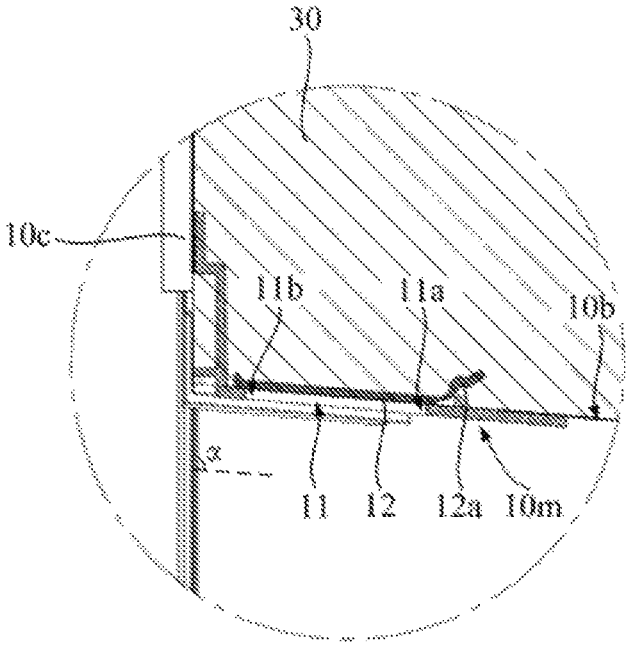
FIG. 2 is an enlarged, sectional view of an area A of the shell shown in FIG. 1.

Referring to FIG. 1 and FIG. 2, a cooling appliance includes a heat insulation shell 100, where the shell 100 includes an outer wall 10 and an inner wall 20 that are spaced. The inner wall 20 encircles a chamber 20*a* used for refrigeration or freezing; the outer wall 10 is encircled by splicing multiple plates, including a top plate 10*a*, a bottom plate 10*b*, a back plate 10*c*, and a side plate (not shown in FIGS. 1 and 2), the outer wall 10 is coated on the inner wall 20, and a heat insulation material 30 is filled between the outer wall 10 and the inner wall 20, so that the cooling appliance has a good heat preservation effect.

The heat insulation material 30 is usually formed by filling a foaming material (such as a polyurethane foaming material) between the outer wall 10 and the inner wall 20 in a foaming process of the shell 100. To enable the foaming material to be filled between the outer wall 10 and the inner wall 20, the outer wall 10 is provided with a filling hole 11 and a baffle plate 12, and the filling hole 11 and the baffle plate 12 form a foaming valve used for filling the foaming material. The baffle plate 12 is disposed on an inner surface (a surface faced to the inner wall) of the outer wall 10.

Before the foaming material is filled in the shell 100, the baffle plate 12 can move to open the filling hole 11 or close the filling hole 11. When the foaming material is filled in the shell 100, the baffle plate 12 is opened, and the foaming material is filled between the outer wall 10 and the inner wall 20 from the outside through the filling hole 11. After filling of the foaming material is completed, the foaming material is cured between the outer wall 10 and the inner wall 20 to form the heat insulation material 30. In this case, the baffle plate 12 is fixed by the cured heat insulation material 30.

Referring to FIG. 2, the baffle plate 12 has a connecting end 12*a*, the connecting end 12*a* is hinged on the outer wall 10, and the baffle plate 12 rotates around the connecting end 12*a*, to open or close the filling hole 11. The filling hole 11 has a near end 11*a* close to the connecting end 12*a* and a far end 11*b* away from the connecting end 12*a*.

In this embodiment, the filling hole 11 is disposed on the bottom plate 10*b*, and an area 10*m* that is of the outer wall 10 and on which the filling hole 11 inclines to the inner wall 20 in a direction from the near end 11*a* to the far end 11*b*. That is, an included angle $\alpha$ between the area 10*m* on the bottom plate 10*b* and the vertically disposed back plate 10*c* is an obtuse angle.

Figure 3:
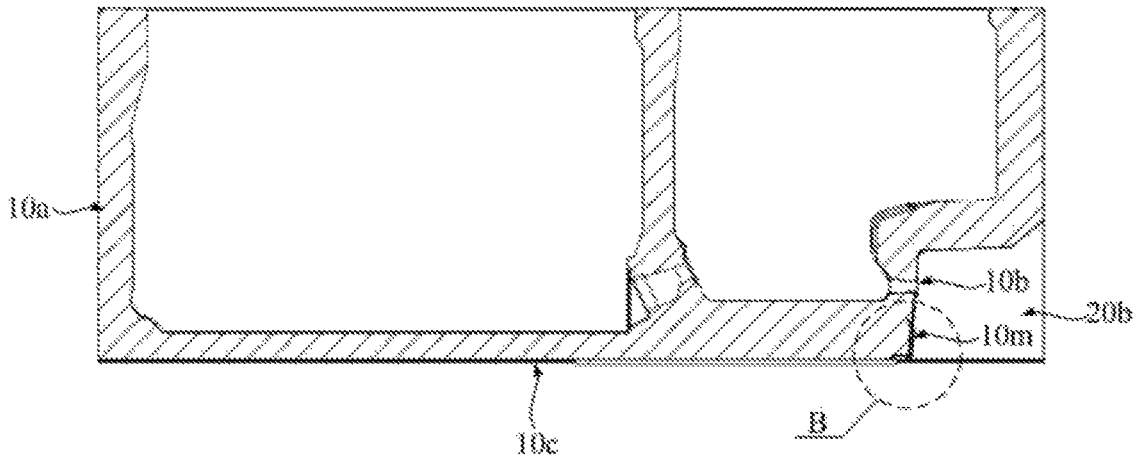
FIG. 3 is a sectional view of the shell of the cooling appliance shown in FIG. 1 when it is placed in a foaming process.
Figure 4:
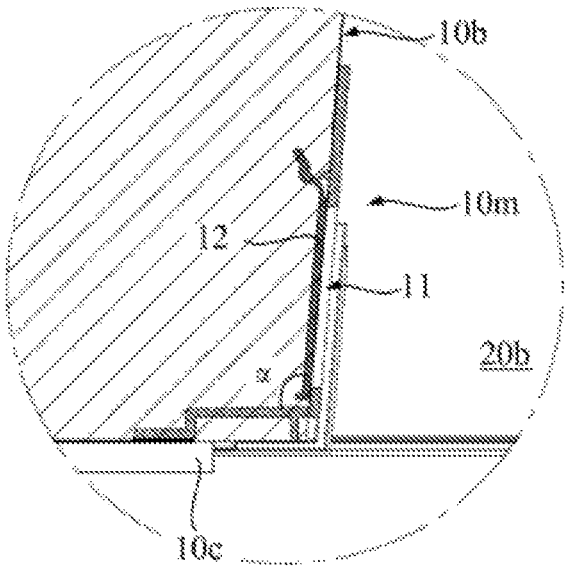
FIG. 4 is an enlarged, sectional view of an area B of the shell shown in FIG. 3.

Referring to FIG. 3 and FIG. 4, in a process of filling the foaming material in the shell 100, a filling tube is inserted into the filling hole 11, and the baffle plate 12 is opened. In this case, the cooling appliance is usually placed in a lie-down manner, that is, the back plate 10*c* is horizontally placed. Because an obtuse angle is formed between the area 10*m* on which the filling hole 11 is disposed and the back plate 10*c*, in the foaming process, the area 10*m* inclines in a direction away from the back plate 10*c*, and an inner surface of the area 10*m* inclines upward.

After filling of the foaming material is completed, the filling tube is pulled out of the filling hole 11. Even if the baffle plate 12 hinged on the bottom plate 10*b* is driven only by gravity to fall down, the baffle plate 12 can be well adhered to the inner surface of the area 10*m* (in this case, the baffle plate 12 also inclines, and the effect of gravity provides the baffle plate 12 with a trend of moving to the bottom plate 10*b*), so that the filling hole 11 can be blocked completely, to prevent the foaming material between the outer wall 10 and the inner wall 20 from leaking to the outside.

Specifically, in this embodiment, the bottom plate 10*b*, on the whole, inclines to the inner wall 20. Therefore, in the foaming process, the entire bottom plate 10*b* inclines in the direction away from the back plate 10*c*, and the entire inner surface of the back plate 10*b* inclines upward. In this case, the filling hole 11 may be disposed at any position of the bottom plate 10*b*, and the corresponding baffle plate 12 can fall down under the effect of gravity, to be adhered to an inner surface of the bottom plate 10*b*, to block the corresponding filling hole 11, and prevent leakage of the foaming material.

In this case, the bottom plate 10*b* may be provided with multiple filling holes 11 and multiple baffle plates 12, and the filling holes 11 may be disposed in a one-to-one correspondence to the baffle plates 12, or the multiple filling holes 11 may correspond to one baffle plate 12. In the foaming process, the foaming material may be filled through the multiple filling holes 11, to increase the filling efficiency of the foaming material, and prevent the foaming material from curing in advance due to slow filling.

In other variations, the bottom plate 10*b* may also include different areas. Some of the areas incline to the inner wall 20, and form an obtuse angle with the back plate 10*c*, and the other areas are perpendicular to the back plate 10*c*. In this case, the filling hole 11 is suitable for being disposed on an area of the bottom plate 10*b* forming an obtuse angle with the back plate 10*c*, to be better adhered to the inner surface of the bottom plate 10*b*, and block the filling hole 11.

It should be noted that, the baffle plate 12 of this embodiment is hinged on the bottom plate 10*b*, and the baffle plate 12 rotates around a hinge shaft to fall down under the effect of gravity, to close the filling hole. In other variations, a torsion spring may be disposed on the hinge shaft, and the torsion spring is suitable for driving the baffle plate 12 to rotate to press the bottom plate 10*b*, thereby further making the baffle plate 12 better adhered to the bottom plate 10*b*.

In addition, in addition to hinging the baffle plate 12 on the bottom plate 10*b*, the baffle plate 12 may be connected to the bottom plate 10*b* in other manners. For example, the baffle plate 12 is configured as an elastic piece, and the baffle plate 12 is enabled, by using an elastic force, to press the bottom plate 10*b*, to block the filling hole 11.

In this embodiment, the reason for disposing the filling hole 11 on the bottom plate 10*b* is as now described.

First, in the foaming process, the back plate 10*c* of the cooling appliance is horizontally placed, and the filling hole 11 is disposed on the bottom plate 10*b*, so that the filling tube of the foaming material can be inserted into the filling hole 11 conveniently, to fill the foaming material between the outer wall 10 and the inner wall 20.

Second, because the filling hole 11 is disposed on the bottom plate 10*b*, the baffle plate 12 is also disposed on the bottom plate 10*b*, so that the baffle plate 12 can fall down under the effect of gravity to be adhered to the bottom plate 10*b*, to block the filling hole 11, thereby simplifying the installation design between the baffle plate 12 and the bottom plate 10*b*.

Third, when the cooling appliance is used, the bottom plate 10*b* is faced to the ground, so that even if the bottom plate 10*b* is provided with the filling hole 11, it is difficult to be noticed by consumers, and therefore, the cooling appliance has a better appearance. Moreover, the bottom of the bottom plate 10*b* is usually provided within an accommodating space 20*b* used for disposing a compressor, and after the accommodating space 20*b* is coated, the bottom plate 10*b* is not exposed, thereby further improving the appearance of the cooling appliance.

In other variations, the top plate 10*a* may also be provided with a filling hole and a baffle plate, or the side plate is provided with a filling hole and a baffle plate, provided that the area on which the filling hole is located inclines to the inner wall 20 in a direction from the near end to the far end. Therefore, the baffle plate can still fall down under the effect of gravity, and is adhered to the area on which the filling hole is located, to block the filling hole 11.

In addition, if the cooling appliance is placed laterally in the foaming process, that is, the side plate is horizontally placed, the back plate 10*c* may be provided with a filling hole and a baffle plate. For the specific disposing manner of the filling hole and the baffle plate, reference may be made to the foregoing embodiment. Details are not described herein again.

Still referring to FIG. 1 and FIG. 2, an angle by which the area on which the filling hole 11 is located inclines to the inner wall 20 is controlled to be less than 30°. That is, an angle $\alpha$ between the bottom plate 10*b* and the back plate 10*c* is controlled to be: $90° < \alpha \leq 120°$. If the inclined angle is excessively large, it may be difficult to dispose the bottom plate 10*b*, making the assembly technique complex, and increasing the manufacturing difficulty; and making it difficult to insert the filling tube of the foaming material into the filling hole 11, and increasing the foaming difficulty.

In this embodiment, one side of the baffle plate 12 away from the connecting end 12*a* is further provided with a balancing weight (not shown in the figure), the clump weight can make the baffle plate 12 quickly rotate to fall down, and provide the fallen baffle plate 12 with a large adhesive force with the bottom plate 10*b*, to better block the filling hole 11.

Second Embodiment

Figure 5:
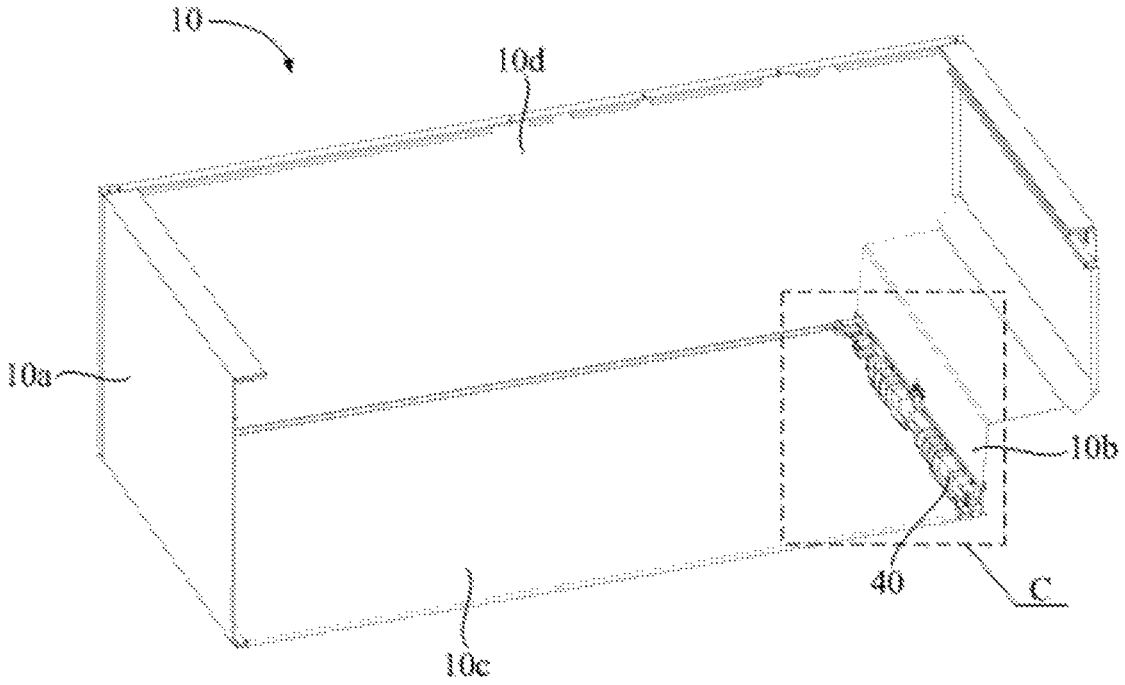
FIG. 5 is a perspective view of an outer wall of a shell of the cooling appliance according to a second embodiment of the invention, to display a filling hole and a baffle plate.
Figure 6:
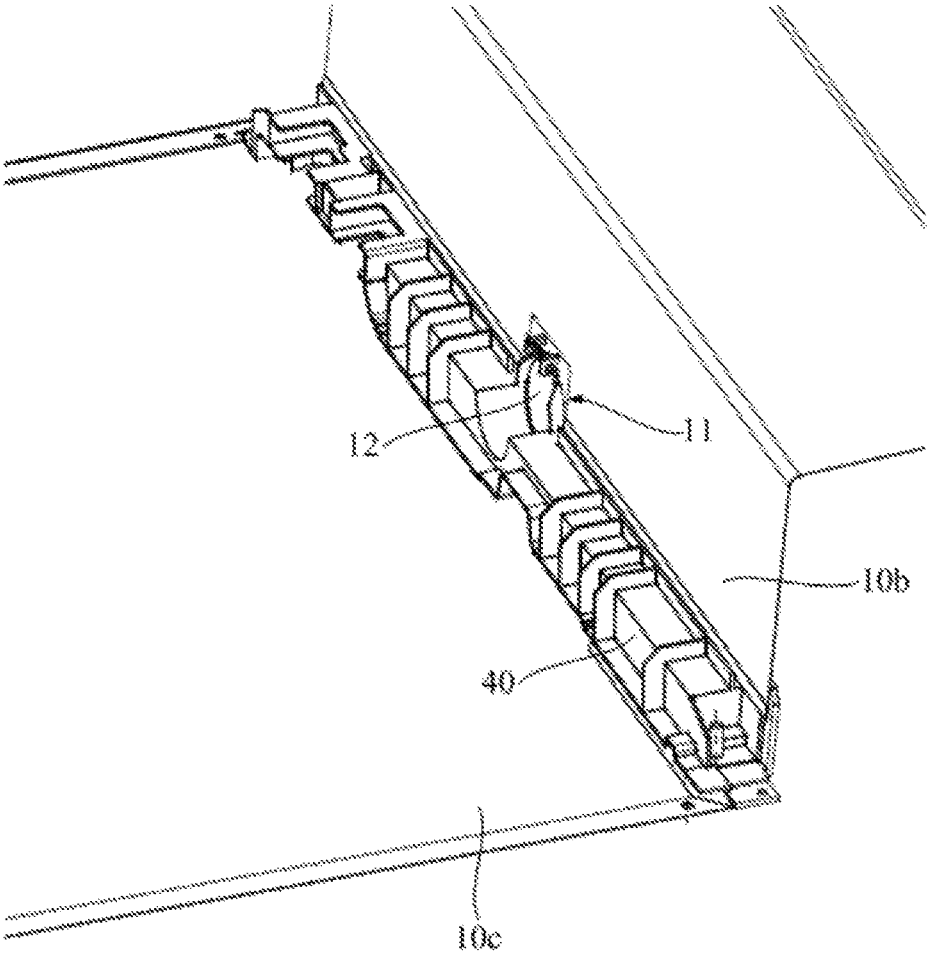
FIG. 6 is an enlarged, perspective view of an area C of the shell shown in FIG. 5.

Referring to FIG. 5 and FIG. 6, the outer wall 10 includes the top plate 10*a*, the bottom plate 10*b*, the back plate 10*c*, the side plate 10*d*, and a beam 40. The beam 40 fixedly connects the back plate 10*c* to the bottom plate 10*b*, and both the filling hole 11 and the baffle plate 12 are disposed on the beam 40.

The top plate 10*a*, the bottom plate 10*b*, the back plate 10*c*, and the side plate 10*d* are usually punch-formed, and are relatively thin. When the baffle plate 12 is directly disposed on the outer wall 10, the outer wall 10 may be deformed. If a base is first disposed on the filling hole 11, and then the baffle plate 12 is disposed on the base, the structure of the foaming valve becomes more complex, and the production and manufacture costs are increased.

In this embodiment, both the filling hole 11 and the baffle plate 12 are disposed on the beam 40, that is, the foaming valve is integrated on the beam 40. Because the beam 40 is relatively thick, and is relatively strong, disposing the filling hole 11 and the baffle plate 12 on the beam 40 basically does not deform the beam 40. Therefore, the technique of disposing the filling hole 11 and the baffle plate 12 on the outer wall 10 can be simplified, the production processes are reduced, and the production costs are reduced.

Figure 7:
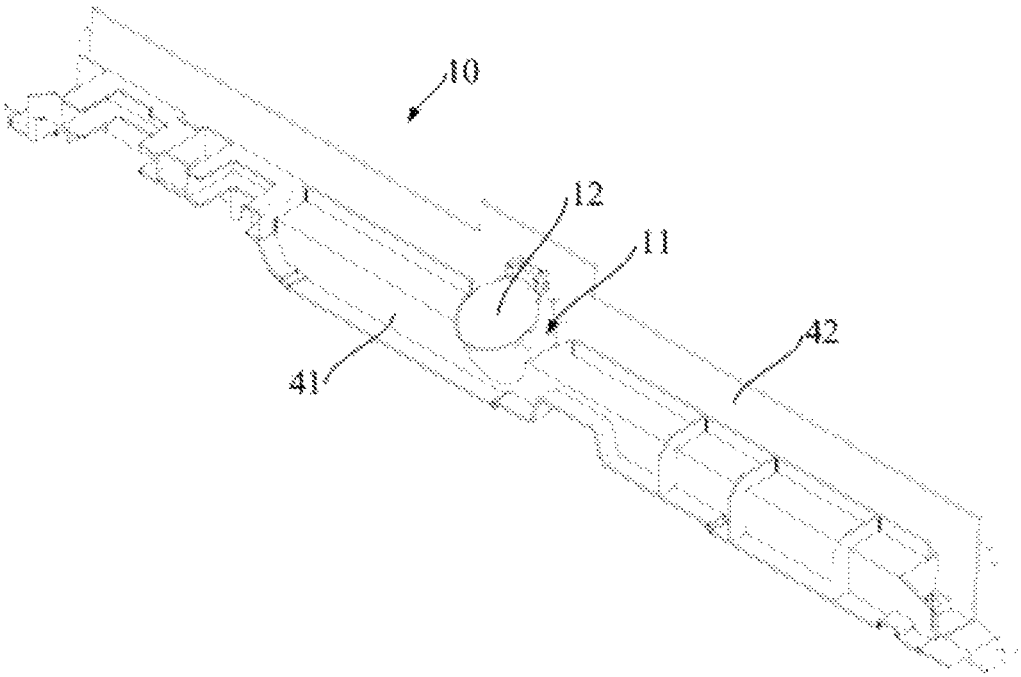
FIG. 7 is a perspective view of a beam connecting two plates shown in FIG. 6.
Figure 8:
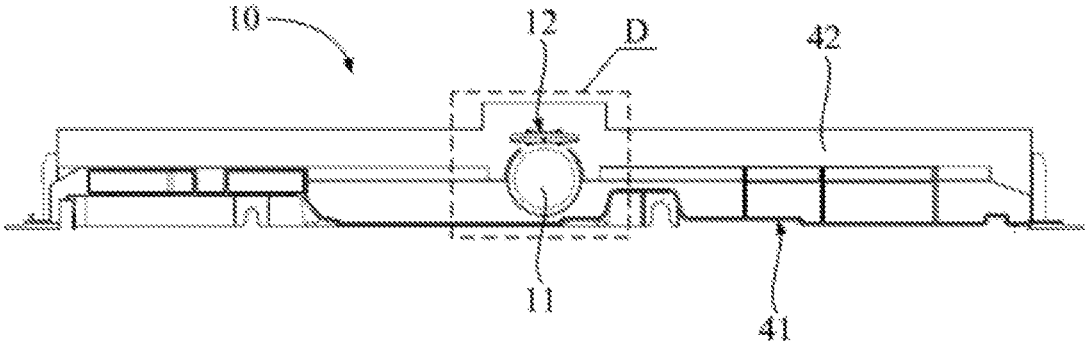
FIG. 8 is a front view of the beam connecting the two plates shown in FIG. 6.

Referring to FIG. 7 and FIG. 8, the beam 40 has a first wall 41 and a second wall 42 that are fixedly disposed. The first wall 41 is fixedly connected to the back plate 10*c*, the second wall 42 is fixedly connected to the bottom plate 10*b*, and the filling hole 11 is disposed on the second wall 42.

In the foaming process, the back plate 10*c* of the cooling appliance is horizontally placed, and the filling hole 11 is disposed on the second wall 42, so that the filling tube of the foaming material can be inserted into the filling hole 11 conveniently. In addition, because the baffle plate 12 is disposed on the second wall 42, the baffle plate 12 can fall down under the effect of gravity to be adhered to the second wall 42, to block the filling hole 11, and simplify the design of the baffle plate 12. In addition, when the cooling appliance is used, the second wall 42 is faced to the ground, so that even if the second wall 42 is provided with the filling hole, it is difficult to be noticed by consumers, so that the cooling appliance has a better appearance.

Figure 9:
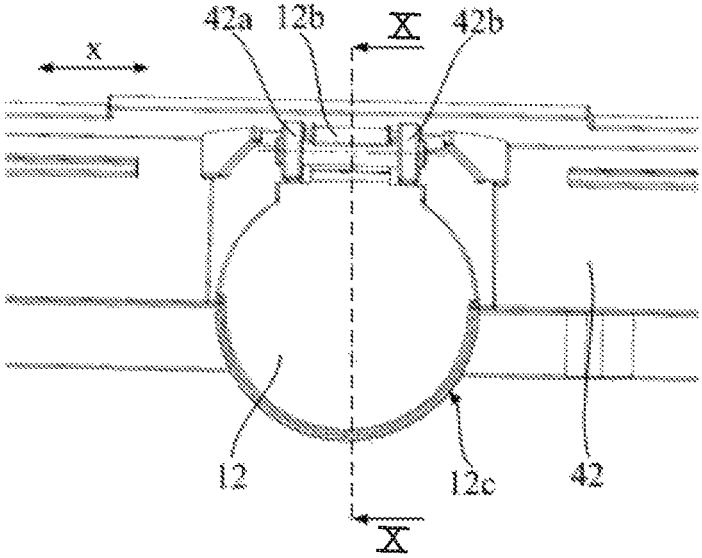
FIG. 9 is an enlarged, front view of an area D of the beam shown in FIG. 8, where the baffle plate is in a closed state in this case.

Referring to FIG. 9, the baffle plate 12 is hinged on the second wall 42. Specifically, the baffle plate 12 has a hinge shaft 12*b*, the second wall 42 is provided with a first lug 42*a* and a second lug 42*b* that protrude to a same direction and that are disposed opposite to each other, two ends of the hinge shaft 12*b* are respectively rotatably inserted in the first lug 42*a* and the second lug 42*b* to implement hinge connection.

In this embodiment, the first lug 42*a* and the second lug 42*b* are disposed opposite to each other along a length direction x of the beam 40, that is, the hinge shaft 12*b* extends along the length direction of the beam 40.

It should be noted that, for a specific form for the baffle plate 12 in the first embodiment to be hinged on the bottom plate 10*b*, reference may be made to this embodiment. In a variation of this technical solution, the baffle plate 12 may also be connected to the second wall 42 in other manners. For example, the baffle plate 12 is configured to be an elastic piece, and the baffle plate 12 is enabled, by using an elastic force, to press the second wall 42, to block the filling hole 11.

Figure 10:
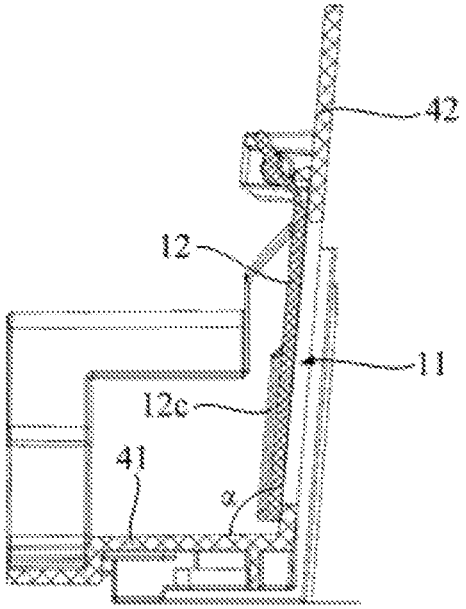
FIG. 10 is a sectional view of the beam shown in FIG. 9 taken along line X-X shown in FIG. 9.
Figure 11:
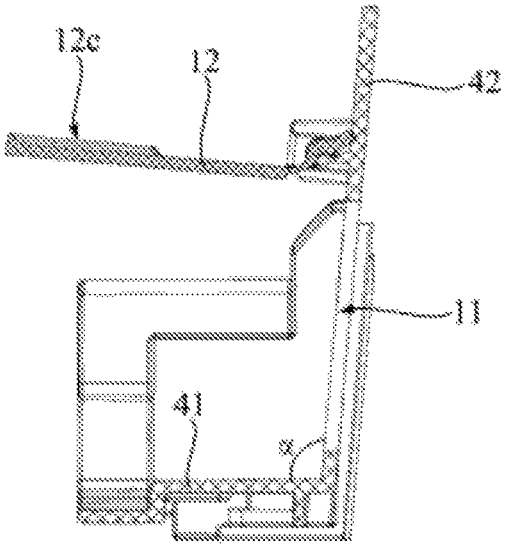
FIG. 11 is a sectional view obtained when the baffle plate disposed on the beam shown in FIG. 10 is opened.

Referring to FIG. 10 and FIG. 11, in this embodiment, the first wall 41 of the beam is adhered to the back plate 10*c*, and the second wall 42, on the whole, inclines to the inner wall. That is, an obtuse angle is formed between the second wall 42 and the first wall 41, to enable the area on which the filling hole 11 is located to incline to the inner wall, so that the baffle plate 12 can be adhered to the second wall 42 under the effect of gravity, to block the filling hole 11.

Specifically, an angle by which the second wall inclines to the inner wall is controlled to be less than 30b. That is, an angle $\alpha$ between the first wall 41 and the second wall 42 is controlled to be: $90° < \alpha \leq 120°$. If the inclined angle is excessively large, it is difficult to dispose the bottom plate 10*c*, making the assembly technique complex, and increasing the manufacturing difficulty; and making it difficult to insert the filling tube of the foaming material into the filling hole, and increasing the foaming difficulty.

In this case, the second wall 42 may be provided with multiple filling holes 11 and multiple baffle plates 12, and the filling holes 11 may be disposed in a one-to-one correspondence to the baffle plates 12, or the multiple filling holes 11 may correspond to one baffle plate 12. The multiple filling holes 11 may be disposed along an extension direction of the beam 40. In the foaming process, the foaming material may be filled through the multiple filling holes 11, to improve the foaming efficiency, and prevent the foaming material from curing in advance due to slow filling.

In other variations, the second wall 42 may also include different areas. Some of the areas incline to the inner wall 20, and form an obtuse angle with the second wall 41. In this case, the filling hole 11 is suitable for being disposed on an area of the second wall 42 forming an obtuse angle with the first wall 41, to be better adhered to an inner surface of the second wall 42, to block the filling hole 11.

Referring to FIG. 9 to FIG. 11, a surface of the baffle plate 12 faced to the inner wall is provided with a clump weight 12*c*, and the clump weight 12*c* is disposed on one side of the baffle plate 12 away from the hinge shaft 12*b*, and disposed around the edge of the baffle plate 12 to form a semicircle shape. The clump weight 12*c* can make the baffle plate quickly rotate to fall down, and provide the fallen baffle plate 12 with a large adhesive force with the bottom plate 10*b*, to better block the filling hole 11. Specifically, the clump weight 12*c* is integrally formed on the baffle plate 12.

For the specific design manner of the clump weight 12*b* in the first embodiment, reference may be made to this embodiment. In other variations, the clump weight 12*b* may be in any other shape, provided that the quality of the baffle plate 12 can be improved. In addition, the clump weight 12*b* may also be fixed on the baffle plate 12 in other forms such as a welding form, and this does not affect the implementation of this technical solution.

In this embodiment, a reinforcing rib is further disposed between the first wall 41 and the second wall 42 of the beam 40, and the reinforcing rib fixedly connects the first wall 41 to the second wall 42, so that the beam 40 is stronger, and when the filling hole 11 and the baffle plate 12 are disposed on the beam 40, it is more difficult for the beam 40 to deform.

It should be noted that, the beam 40 fixedly connects the bottom plate 10*b* to the back plate 10*c*, and this is not a limitation to this embodiment. In other variations, if the beam 40 fixedly connects the top plate 10*a* to the back plate 10*c*, or fixedly connects the back plate 10*c* to the side plate 10*d*, or fixedly connects the top plate 10*a* to the side plate 10*d*, or fixedly connects the bottom plate 10*b* to the side plate 10*d*, the filling hole 11 and the baffle plate 12 may also be disposed on the beam 40, and this does not affect the implementation of this technical solution.

Although the present utility model is disclosed as above, the present utility model is not limited thereto. A person skilled in the art can make various variations and modifications without departing from the spirit and scope of the present utility model. Therefore, the protection scope of the present utility model shall be subject to the scope limited by the claims.

The invention claimed is:

1. A cooling appliance, comprising:

a heat insulation shell having an outer wall and an inner wall that are spaced apart from each other, and a heat insulation material disposed between said outer wall and said inner wall, said heat insulation material formed by foaming a foaming material injected between said outer wall and said inner wall in a foaming process of said heat insulation shell;

said outer wall of said heat insulation shell having a plurality of plates being joined together to form a part of said outer wall, at least one beam disposed between two neighboring plates of said plates to fixedly connect said two neighboring plates and a filling hole formed in said at least one beam;

a baffle plate disposed between said outer wall and said inner wall and used for closing said filling hole, said baffle plate connected to said outer wall, and said filling hole having a near end close to a connecting end of said baffle plate and a far end away from said connecting end; and said outer wall inclining towards said inner wall in a direction from said near end to said far end on an area on which said filling hole is disposed.

2. The cooling appliance according to claim 1, wherein an angle by which said area on which said filling hole is formed inclines towards said inner wall is less than 30°.

3. The cooling appliance according to claim 1, wherein said baffle plate has a balancing weight on a first side of said baffle plate away from said connecting end.

4. The cooling appliance according to claim 1, wherein said insert has a plurality of filling holes formed therein, and said plurality of filling holes are disposed on a same plane.

5. The cooling appliance according to claim 1, wherein said baffle plate is hinged to said beam.

6. The cooling appliance according to claim 5, wherein said baffle plate has a hinge shaft suitable for a hinge connection, and said hinge shaft extends along a length direction of said beam.

7. The cooling appliance according to claim 1, wherein:

said plurality of plates include a back plate and a bottom plate; and said beam contains a first wall and a second wall that are fixedly disposed, said first wall is fixedly connected to said back plate, and said second wall is fixedly connected to said bottom plate.

8. The cooling appliance according to claim 7, wherein said filling hole is formed in said second wall.

9. The cooling appliance according to claim 7, wherein an included angle $\alpha$ between said first wall and said second wall satisfies: $90° < \alpha \leq 120°$.

* * * * *